US006802507B2

(12) United States Patent
Inoue

(10) Patent No.: US 6,802,507 B2
(45) Date of Patent: Oct. 12, 2004

(54) ROTARY REEL UNIT FOR GAME MACHINE

(75) Inventor: Haruo Inoue, Tokyo (JP)

(73) Assignee: Dragon Co., Ltd., Tokyo (JP)

( * ) Notice: Subject to any disclaimer, the term of this patent is extended or adjusted under 35 U.S.C. 154(b) by 0 days.

(21) Appl. No.: 10/232,697

(22) Filed: Sep. 3, 2002

(65) Prior Publication Data

US 2004/0041340 A1 Mar. 4, 2004

(51) Int. Cl.[7] ..... A63B 71/00

(52) U.S. Cl. ..... 273/143 R; 273/138 A; 463/20; 463/21

(58) Field of Search ..... 273/143 R, 138, 273/138.2; 463/20, 16, 17

(56) References Cited

U.S. PATENT DOCUMENTS

| | | | | | |
|---|---|---|---|---|---|
| 1,912,992 | A | * | 6/1933 | Mills | 194/295 |
| 4,200,291 | A | * | 4/1980 | Hooker | 273/143 R |
| 4,262,906 | A | * | 4/1981 | Heywood | 273/143 R |
| 4,373,727 | A | * | 2/1983 | Hooker et al. | 273/143 R |
| 4,912,389 | A | * | 3/1990 | Eguchi | 318/696 |
| 5,395,111 | A | * | 3/1995 | Inoue | 273/143 R |
| 5,584,764 | A | * | 12/1996 | Inoue | 463/20 |
| 5,609,524 | A | * | 3/1997 | Inoue | 463/20 |
| 5,667,219 | A | * | 9/1997 | Ishibashi | 273/143 R |
| 5,695,188 | A | * | 12/1997 | Ishibashi | 273/143 R |
| 5,722,891 | A | * | 3/1998 | Inoue | 463/20 |
| 5,752,881 | A | * | 5/1998 | Inoue | 463/20 |
| 5,803,451 | A | * | 9/1998 | Kelly et al. | 273/118 R |
| 5,839,957 | A | * | 11/1998 | Schneider et al. | 463/20 |
| 5,984,782 | A | * | 11/1999 | Inoue | 463/20 |
| 6,029,794 | A | * | 2/2000 | Tamaki | 194/338 |
| 6,086,066 | A | * | 7/2000 | Takeuchi et al. | 273/143 R |
| 6,126,165 | A | * | 10/2000 | Sakamoto | 273/143 R |
| 6,398,220 | B1 | * | 6/2002 | Inoue | 273/142 R |
| 6,540,227 | B2 | * | 4/2003 | Inoue | 273/143 R |
| 6,554,703 | B1 | * | 4/2003 | Bussick et al. | 463/20 |

FOREIGN PATENT DOCUMENTS

| | | | | | |
|---|---|---|---|---|---|
| EP | 0 023 136 | A1 | * | 1/1981 | G07F/17/34 |
| GB | 2 082 329 | A | * | 3/1982 | G01B/7/30 |
| GB | 2 089 086 | A | * | 6/1982 | G07F/17/34 |
| JP | 408294566 | A | * | 11/1996 | A63F/5/04 |
| JP | 9-75506 | A | * | 3/1997 | A63F/5/04 |
| JP | 9-103539 | A | * | 9/1997 | A63F/5/04 |
| JP | 10-277202 | | * | 10/1998 | A63F/5/04 |
| JP | 2001-170298 | A | * | 7/2001 | A63F/7/02 |
| JP | 2002-28278 | A | * | 1/2002 | A63F/5/04 |
| JP | 2002-0282728 | | | 1/2002 | |
| JP | 2002-210070 | A | * | 7/2002 | A63F/5/04 |

* cited by examiner

*Primary Examiner*—Derris H. Banks
*Assistant Examiner*—Dolores R. Collins
(74) *Attorney, Agent, or Firm*—Ronald E. Greigg

(57) ABSTRACT

A rotary reel unit for a game machine mounted to a frame through a support member fixedly provided in a vertical state, the rotary reel unit including a fixing member fixed to one of sidewalls of the support member, having a attachment base plate; a movable member provided at the attachment base plate, having a photograph sensor to an index provided to the rotary reel; the attachment base plate provided at least one engaging member; an engaged plate part of the movable member having a plurality of engaged plate parts provided continuously thereto on the base line L positioned at the same direction as a circumferential direction of the rotary reel; and the engaging member detached to the engaged plate parts in serial when the position of the photograph sensor is re-positioned by controlling the movable member so that the position of a sensor is enable correcting easily by a person who is not an expert.

6 Claims, 11 Drawing Sheets

ROTARY REEL UNIT FOR GAME MACHINE

BACKGROUND OF THE INVENTION

This invention relates to a rotary reel unit for the game machine such as a slot machine and pachinko, equipped with the rotary reel.

Japanese Patent Laid-Open Publication No. Hei 10-277202 discloses a conventional example of the rotary reel of the type with which this invention is concerned. The indicated embodiment in this publication discloses a rotary reel which is premised with attaching the reel belt having two or more step-lines in the axial direction to the outer circumferential wall of the rotary reel, the attachment device is loosened first, after that, allowing moving with adjustment a moving object having a photo sensor at a tip part thereof to move with adjustment along the circular outer circumferential wall of a bracket, then fixing the movable object to the bracket by tightening the attachment device, in order to unite the required stop position (step-line) of the rotary reel with a cover board (index: directions means which shows a standard position) without doing repair work for sticking when the repair work is needed for the reel belt at the time of the assembly of unit.

However, in the above-mentioned composition, since fixing user's eyes sensuously operates the position adjustment of the moving object, such adjustment is troublesome and there is a problem to delicate it.

In addition, the phenomenon in which the symbol, arranged at the required position, of the rotary reel shifts from a desired stop-position and stops is caused by the error in the combination of each member including a drive motor, rotary reel, and support in many cases.

SUMMARY OF THE INVENTION

Accordingly, it is an object of the present invention to provide the rotary reel unit for game machine that the position of a sensor is correctable easily by the person who is not an expert. It is another object of the present invention to provide the rotary reel unit for game machine that the position of a sensor is correctable gradually. It is still another object of the present invention to provide the rotary reel unit for game machine that is able to utilize the narrow radius space of a rotary reel effectively and to attain the above-mentioned object to the game machine equipped with the rotary reels such as a slot machine with a comparatively short radius of the rotary reels. It is further object of the present invention to provide the rotary reel unit for game machine that is able to reduce the number of the parts to constitute it and is able to combine each member rationally.

A rotary reel unit for the game machine in the present invention provided to a frame 1 via a support member 4 fixedly provided at a vertical state, the rotary reel unit comprises a mounting member 7 supported on one of sidewalls of the support member, having an attachment base plate 9; a movable member 21 provided at the attachment base plate 9, having a photo sensor 40 to an index provided to the rotary reel 50; the attachment base plate 9 including at least one engaging member; an engaged plate part 22 of the movable member 21 having a plurality of engaged plate positions 27 provided continuously thereto on the base line L positioned along or arc corresponding to the circumferential direction of the rotary reel; and the engaging member detached to the engaged plate parts 27 one by one when the position of the photo sensor 40 is re-positioned by controlling the movable member 21.

In the above-mentioned composition, the engaged part 27 is formed suitably and continuously on the base line L of the attachment base plate 9 of the fixing member 7 to the same direction as a circumference direction of the rotary reel, and at least one engaging member 31 (32) is provided at the movable member 21 which overlaps with the attachment base plate 9. Then the engaging member 31 may detach to the engaged part 27 gradually when the position of the sensor 40 is corrected relatively by operating the movable member 21.

The word of "gradual" means that not only when one of engaging members detach to the engaging hole in serial continuously, but also when the first and second engaging members 31 and 32 detach to the engaging hole of the movable member 21 by turns.

The novel features which are believed to be characteristic of the invention, both as to its organization and method of operation, together with further objects and advantages thereof, are described below with reference to the accompanying drawings in which a presently preferred embodiment of the invention is illustrated as an example.

It is to be expressly understood, however, that the drawings are for the purpose of illustration and description only, and are not intended as a definition of the limits of the invention.

BRIEF DESCRIPTION OF THE DRAWINGS

FIG. 1 is an outline explanatory view showing an example of the embodiment of the present invention;

FIG. 2 is a partially cutaway view showing an example of the embodiment of the present invention;

FIG. 3 is a rear view of the principal part of the present invention which is shown from the arrow direction in FIG. 2;

FIG. 4 is an exploded perspective view based on FIG. 2 and view which rotated 90 degrees thereof;

FIG. 5 is an assembled perspective view based on FIG. 2 and view which rotated 90 degrees thereof;

FIG. 6 is an explanatory view showing the engaging relationship between an engaged hole of a movable member and an engaging member of a fixing member;

FIG. 7 is an explanatory view in the case that a movable member allows to adjust in the direction of a base line L;

FIGS. 8 to 10 are explanatory views for step of the engaging member in the case that a movable member moves in the direction of base line L; and FIG. 11 is an explanatory view for explaining the effect of an example of the present invention.

DETAILED DESCRIPTION OF THE PREFERRED EMBODIMENTS

Preferred embodiments of the present invention are described in more detail below referring to the accompanying drawings.

Figure 1:
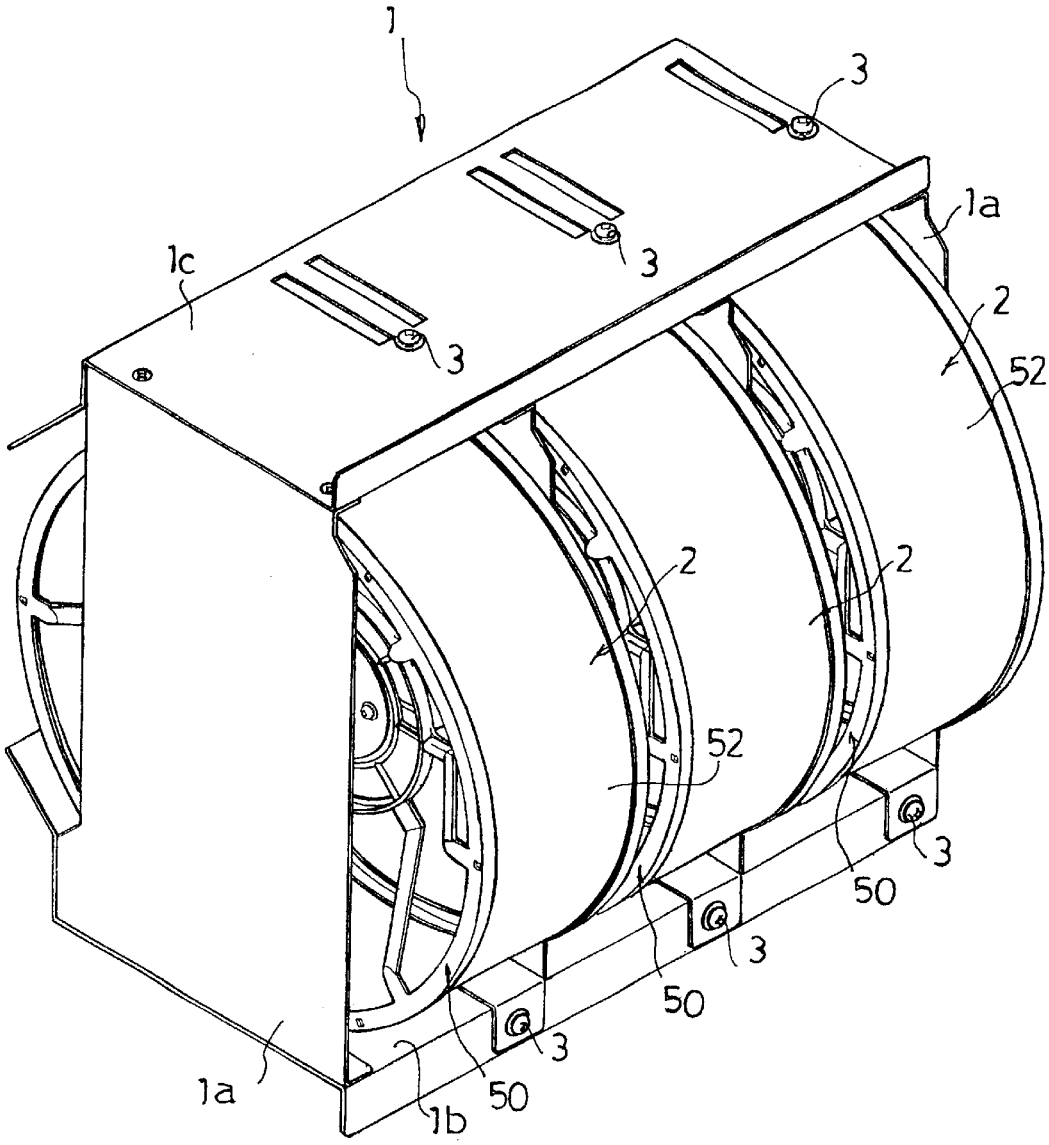
FIGS. 1 to 10 illustrate each explanatory drawing showing an example of this invention.

FIG. 1 illustrates an example of the embodiment explained attached condition in a game machine (for example, slot machine). The numeral 1 shows a frame having three rotary reel units 2 in total attached therein at a parallel state via a plurality of adherence implements 3. In addition, the numeral 1*a* shows sidewalls provided at right and left sides of frame 1, the numeral 1*b* shows a bottom wall, the numeral 1*c* shows an upper wall, and the forward and backward portions thereof have openings.

Figure 2:
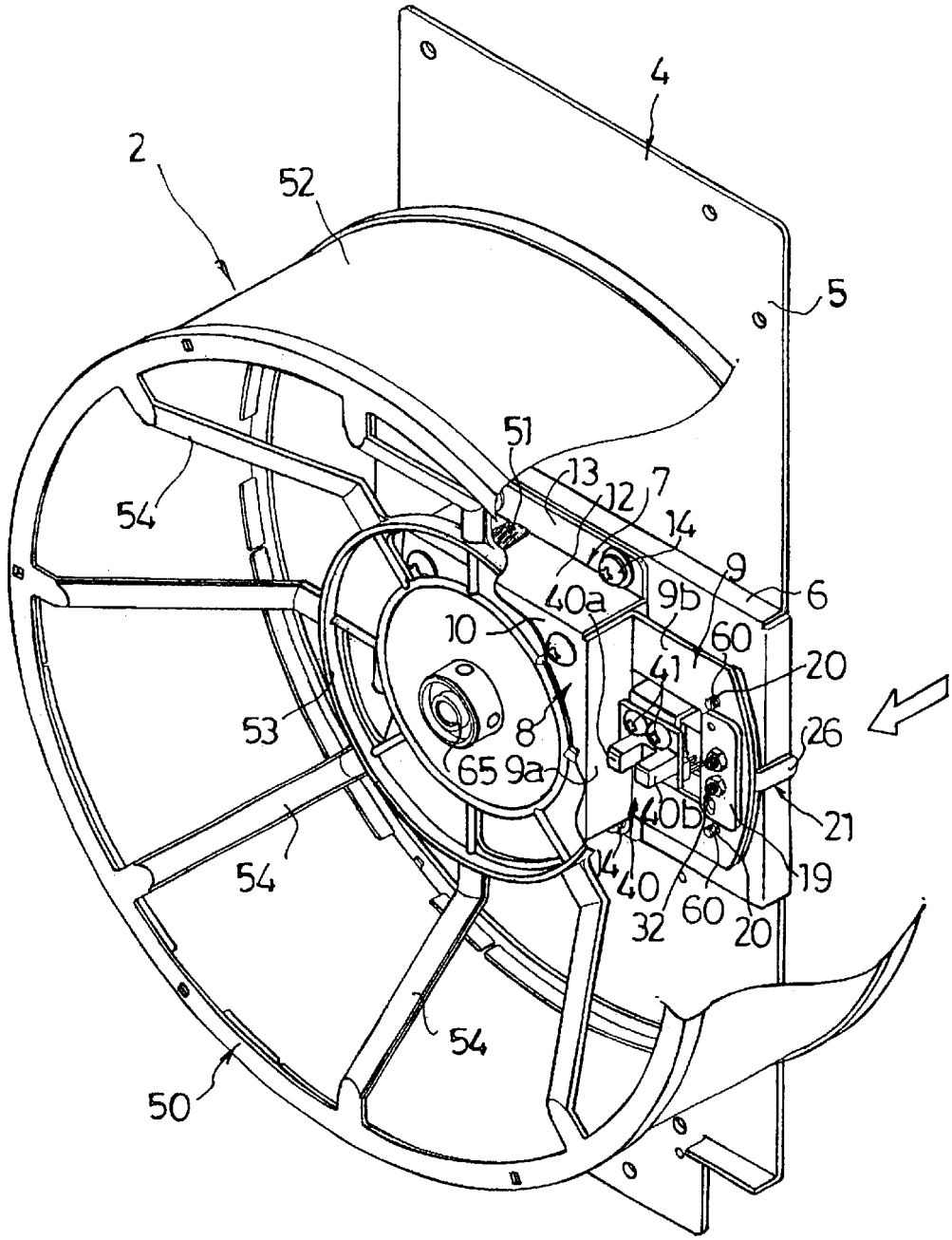
Figure 3:
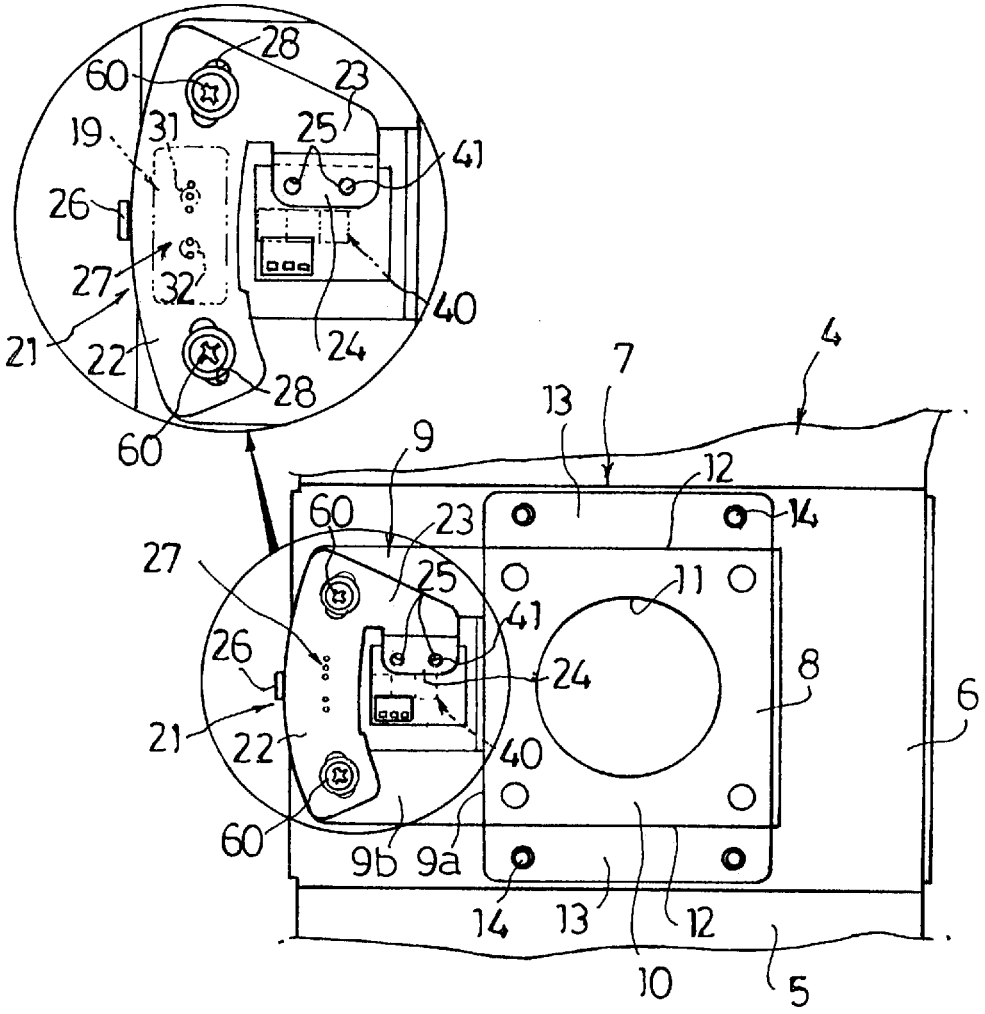

FIG. 2 illustrates one of the rotary reel units 2 which basically includes a support member 4 fixed in the frame 1 in a vertical position; a mounting member 7 fixed to the support member 4 directly or indirectly; a movable member or adjusting lever 21 provided adjustably relative to the fixing member 7, having a photo sensor 40 as a sensor member; the fixing member 7 having a detent or engaging means (or engaged means) 31, 32 engaging with an engaged part (or engaging part) provided at the movable member 21 in serial; and a movable support pins 60 for adjustment provided to the fixing member 7, having a function for a fulcrum by sliding with an inner wall of an adjustable elongated slot 28 of the movable member 21 when the movable member 21 is adjusted to move to the circumferential direction of the rotary reel. Then it is explained to the principal part of this invention as follows.

(1) Support Member

The support member 4 further includes a support member body 5 formed in the shape of a square, fixing upper and bottom ends thereof to the bottom wall 1*b* and upper wall 1*c* of the frame 1 respectively; and a central support plate 6 formed in the shape of a base plate, fixing to a central part of one of the sidewalls to the horizontal direction.

(2) Fixing Member

Figure 4:
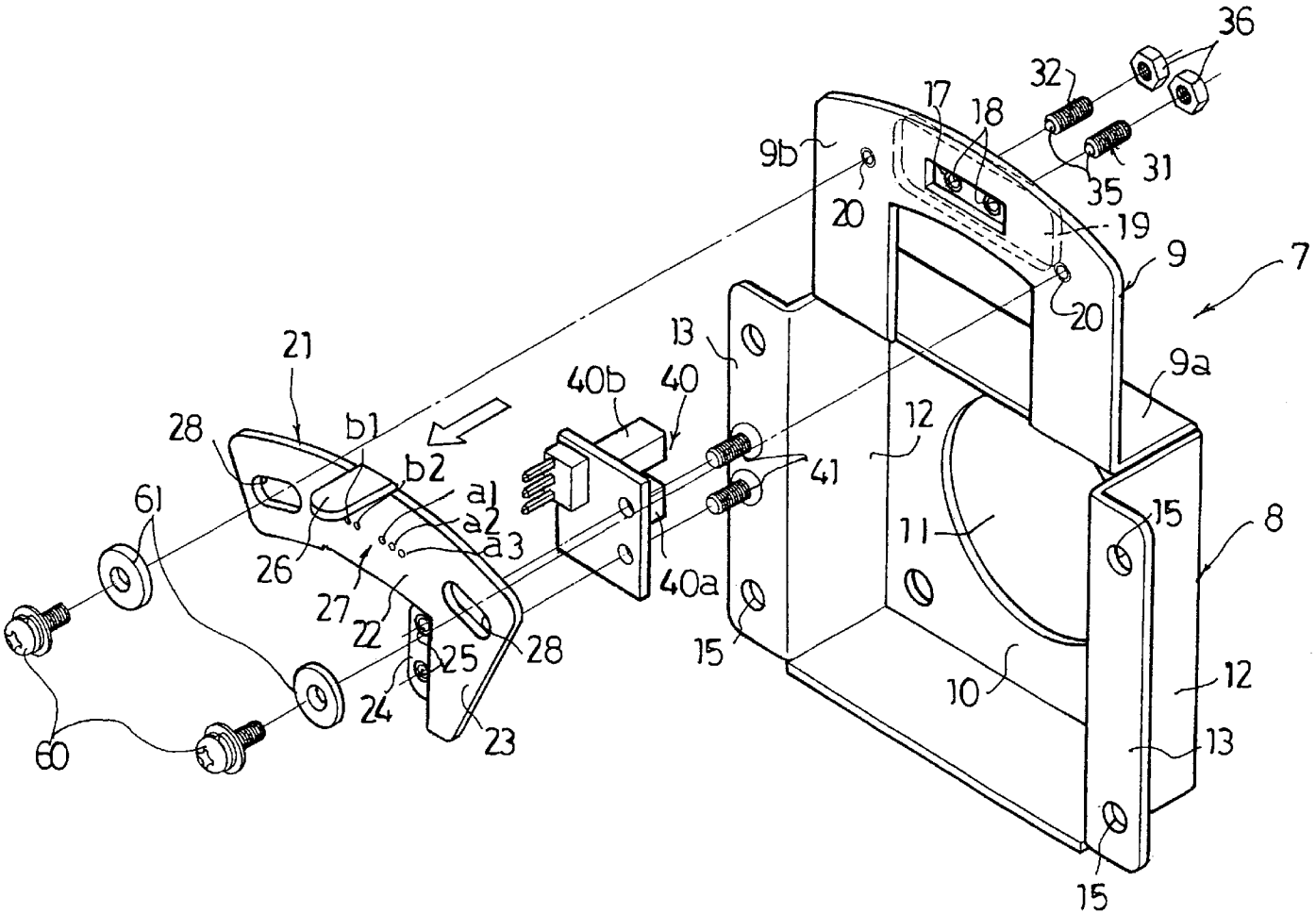
Figure 5:
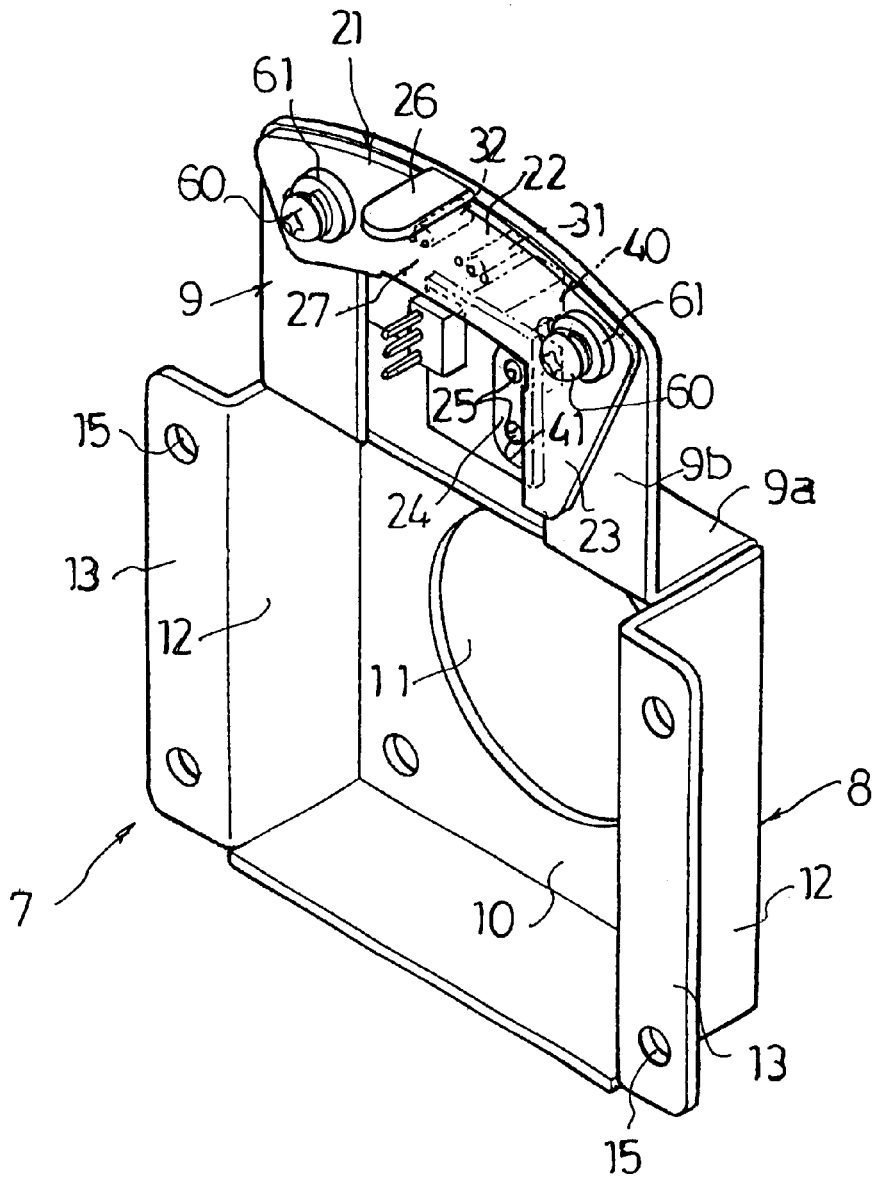

The fixing member 7 is also used as a case covered around the drive motor in this embodiment. The fixing member 7 includes a case 8 for motors having an opening at the attachment side thereof and an attachment base plate 9 for the movable member which is used as one of sidewalls (it is equivalent to a perpendicular right-hand side wall in FIG. 2) of the case 8 for motors. In the case of situation based on FIG. 4, viewing from the arrow direction in FIG. 2, the numeral 10 shows a perpendicular wall, having the quadrangle shape, which constitutes the case 8 for motors. The perpendicular wall 10 is formed an engaged hole 11 for installing the drive motor in the central part of the perpendicular wall 10. The numeral 12 shows an opposite sidewall which is provided continuously to the intersection direction to the perpendicular wall 10, and the sidewalls 12 have attachment flange parts 13 provided with bending at the end part thereof respectively. In addition, holes 15 for adherence implements 14 are formed at the attachment flange part 13. In this embodiment of the present invention, the attachment base plate 9 for the movable member is formed in the shape of an angle (right-angled) at end and includes a short sidewall 9*a* which constitutes a part of the case 8 for motors and a base part 9*b* which is formed with bending at right-angled from the short sidewall 9*a*, and extended outwardly. The base part 9*b* positions to the support board body 5 at a parallel state as illustrated in FIG. 2. Then, the numeral 17 shows an opening formed in the shape of a rectangle and provided at the base part 9*b* suitably. A plate 19 having a plurality of screw holes 18, formed in the shape of a small elongated-plate, is suitably fixed to the opening 17. Then, the plate 19 is fixed to the outer wall of the base part 9*b* so that the opening 17 is covered and closed as illustrated in FIG. 2. The numeral 20 shows two screw holes in total formed at the base part 9*b* respectively, and the screw holes 20 are located upward and downward positions at the base part 9*b* respectively.

(3) Movable Member

The movable member 21 is a generally hook-shaped member and includes an engaged plate part 22 formed in the shape of a arc, extending to the circumference direction of the rotary reel; a projected plate part 23 extending to a radius direction of the rotary reel from the engaged plate part 22; and an attachment board 24 formed in the shape of an angle, fixing at one-side part of the projected plate part 23. In addition, the attachment board 24 has screw holes 25 for attaching the photo sensor, and an operation lever 26, formed in the shape of a fingertip, is provided at the center part of the engaged plate part 22 which overlaps with the base part 9*b* of the fixing member 7 so that the operation lever 26 attends the sidewall of the central support board 6.

(4) Principal Part of the Movable Member

Figure 6:
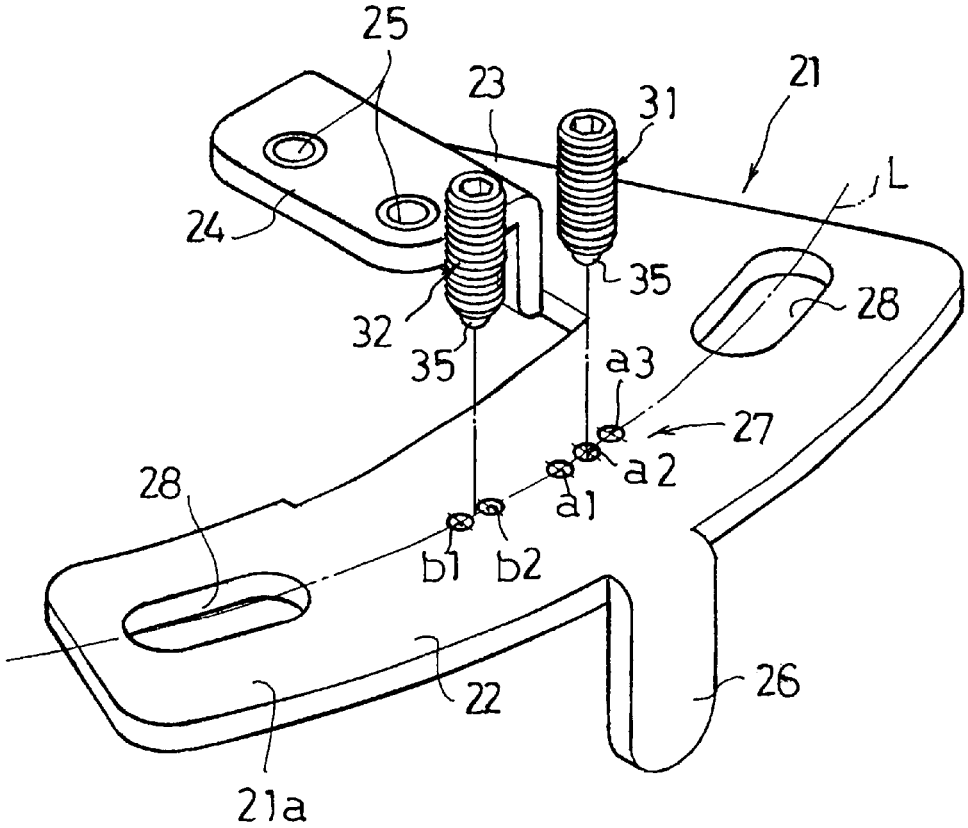
Figure 8:
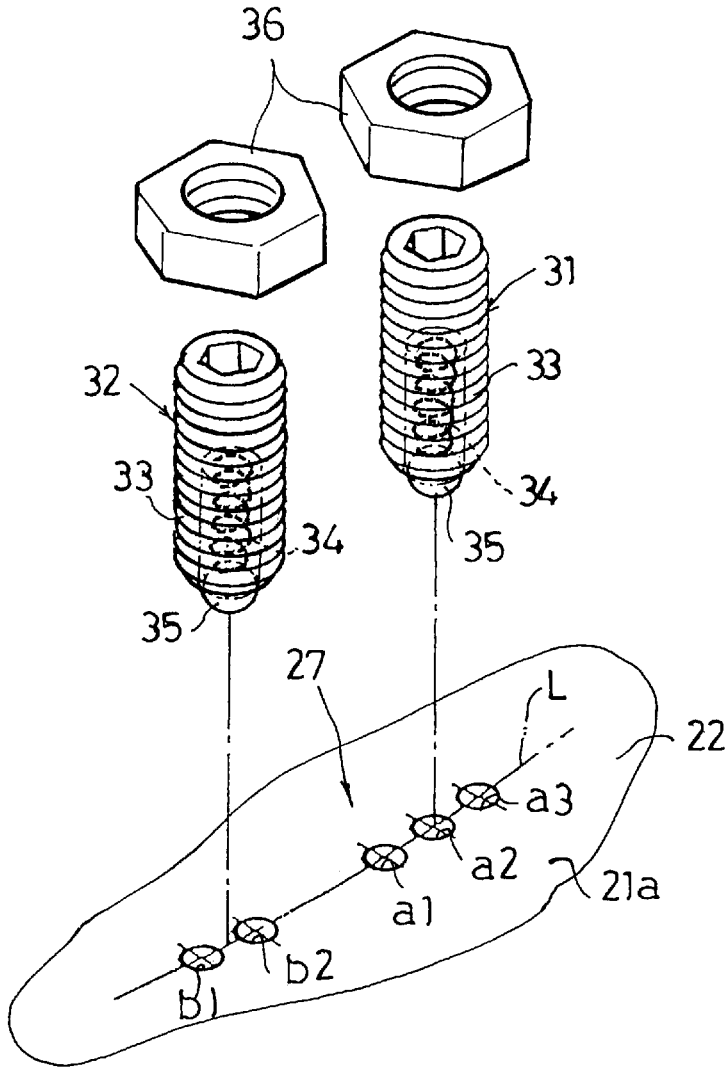

The engaged plate part 22, formed in the shape of an arc, of the movable member 21 extends at the slight arc shape to the circumferential direction of the rotary reel. Then, as illustrated in FIG. 6, a plurality of engaged holes 27 is formed at the engaged plate part 22 (implications which have engaging hole, engaging groove, etc.) continuously so as to pass the base line L (the line is on concentric circle in rotary axle hole of the rotary reel in this embodiment) positioned to the same direction as a circumferential direction of the rotary reel. Moreover, adjustment slots 28 as an example of an adjustment part, which passes on the base line L, is formed at both ends of the engaged plate part 22 respectively. The engaged holes 27 is classified into engaged holes a1, a2, and a3 as the first group and engaged holes b1 and b2 as the second group in this embodiment, and one of a first engaging member 31 or a second engaging member 32 is always engaging either of the engaged holes a1, a2, a3, b1 or b2. When the movable member 21 is moved with steps at every 0.5 by operating the operation lever 26, the first and second engaging members 31 and 32 engage detachably with the corresponding holes alternately. If it elaborates, the step-movement between the engaged hole a1 and a2 of the first group, between the engaged hole a2 and a3 or between the engaged hole b1 and b2 of the second group needs "Two Click", respectively. In addition, as illustrated in FIG. 8 for example, when the first engaging member 31 engages with the engaged hole a2, another second engaging member 32 removes from the engaged hole b1. Therefore, the word of "gradual" in this specification means that not only when one of the engaging members detaches to the engaging hole in serial continuously, but also the first and second engaging members 31 and 32 detach to the engaging hole of the movable member 21 by turns.

(5) First and Second Engaging Members

As illustrated in FIG. 8, the first engaging member 31 includes a comparatively small hollow spiral rod 33 which is screwed into the screw hole 18 of the plate 19 and an engaging ball 35 which is engaged so as to project into a tip portion of the hollow spiral rod and biased towards the projection by the spring 34. The first engaging member 31 is attached detachably to the base part 9*b* of the attachment base plate 9 by using a nut 36 as a fixing member which screwed on the hollow spiral rod 33. The second engaging member 32 is attached at same way of the first engaging member 32, therefore, the same mark is attached. After the first and second engaging members 31 and 32 are attached to the fixing member 7 via the plate 19, these engaging balls 35 are provided detachably to the engaged part 27 of the movable member 21 against the bias of the spring 34 as mentioned above.

(6) Photograph Sensor

The photo sensor 40 equipped with light emiting element 40*a* and receiving element 40*b* is provided on the movable member 21 via a mounting means 41 to screw into the hole 25 of the attachment plate 24. The photo sensor 40 is attached, capable of adjusting the position, to an index 51

(equivalent to the cover board) which is attached in the rotary reel 50. Since the photo sensor is installed into the movable member 21 integrally, it naturally shifts when the movable member 21 moves in serial along the base line L.

(7) Pivot for Adjustment

Two pivots 60 for adjustment pass through the slot 28 for adjustment of the movable member 21 respectively and screw into the screw holes 20 of the attachment base plate 9 of the fixing member 7 respectively. The movable member 21 is screwed on the surface of the inner wall of the base part 9*b* of the attachment base plate 9 via the pivot 60 formed in the shape of a bolt and plate 61 as a washer. When the pivots 60 are loosened, it is possible to adjust the position of the movable member 21. In addition, and the smooth movement is enabled since a projection part 61*a* is provided at the plate 61 and it is inserted into the hole 28.

(8) Rotary Reel

The rotary reel 50 includes an outer circumferential wall 52, as a reel strip, which is arranged the symbol, an annular rib 53 arranged as an axle core of the output axle 65 of the drive motor which is not illustrated, a spoke 54 which connects to the outer circumferential wall 52 and annular rib 53 at the radial state, and an index 51 fixed to the annular rib 53 suitably so as to project to a horizontal direction.

(9) Gradual Adjustment

Figure 10:
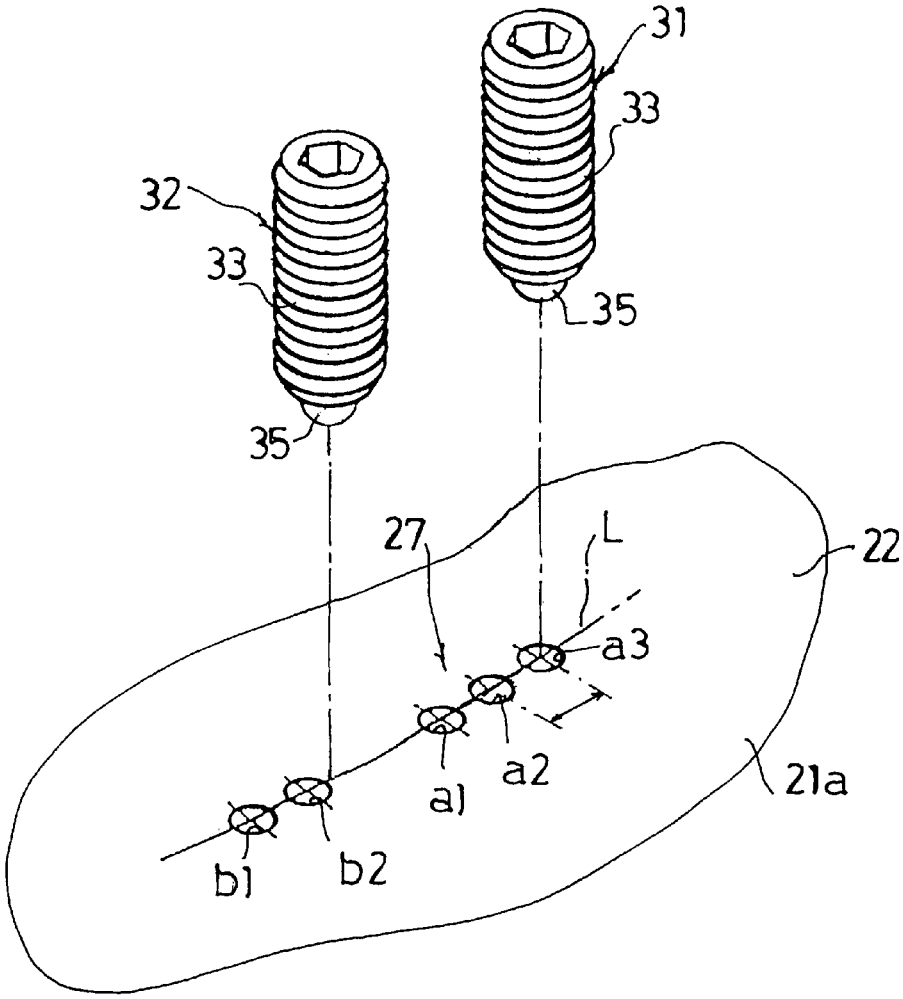

Next, it is explained in the case that the movable member 21 is adjusted gradually to the fixing member 7. After the movable member 21 is attached to the mounting member 7, each engaging ball 35 of the engaging members 31 and 32, screwed into the fixing member 7, engages alternatively with any one of the engaging detents or holes 27. In this case, FIG. 8 illustrates to set at first stage; on the other hand, it is an example to which FIG. 10 illustrates the procedure to adjust the photo sensor 40 step by step. In the condition illustrated in FIG. 7 or FIG. 8, the first engaging member 31 engages with the engaging hole a2, on the other hand, the second engaging member 32 is located in the middle of the engaging hole b1 and engaging hole b2. That is, the first engaging member 31 engages with the engaging hole, on the other hand, the second engaging member 32 does not engage with the engaging hole.

Figure 7:
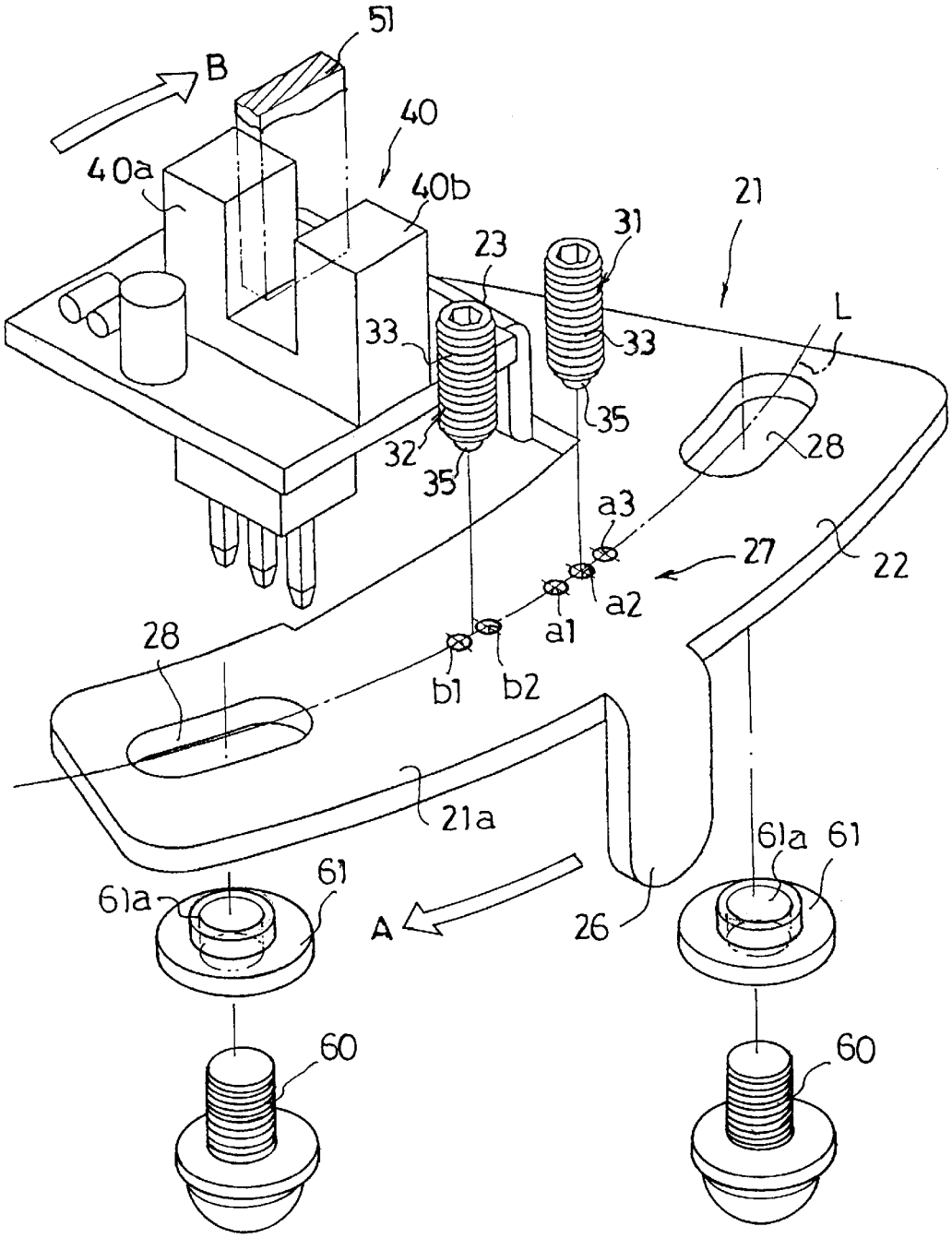
Figure 9:
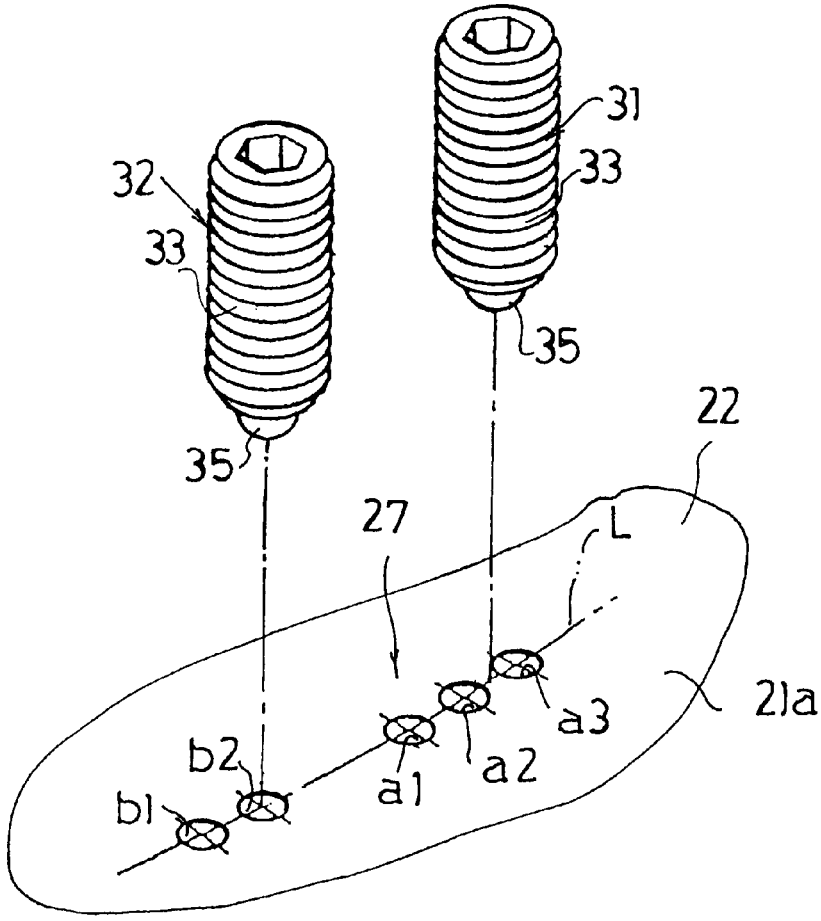

Then, after loosening two pivots 60 for adjustment suitably, a finger is hung on the operation lever 26 of the movable member 21, and the movable member 21 is moved slidely to the direction of arrow A illustrated in FIG. 7. The movable member 21 moves along the base line L to same direction as the circumference direction of the rotary reel 50 via the two slots 28 for adjustment and the pivot 60 for adjustment. Then, as illustrated in FIG. 9, after the movable member 21 is made to move to "0.5 Step", the engaging ball 35 retreats when it resists the spring power of the spring 34 and rides on a flat surface 21*a* of the movable member 21. On the other hand, the engaging ball 35 of the second engaging member 32 enters into the engaging hole b2 from the flat side 21*a* of the movable member 21. Then, when "0.5 Step" movement of the movable member 21 is done further, it will be in the state illustrated in FIG. 10.

Therefore, when a viewpoint is changed here, when it changes in the state illustrated in FIG. 10 from the state illustrated in FIG. 8, when the engaging ball 35 of the first engaging member 31 moves between the engaging hole a2 and a3 (one step) to the movable member 21, it is called "Two clicks were required". In addition, because the first and second engaging member 31 and 32 located at the side of the fixing member detach in "every 0.5 steps" and "keeping turn by turns" to continuous engaging hole 27 located at the movable member-side, the position of the photo sensor 40 is corrected relatively by 0.5 steps in the direction of arrow B illustrated in FIG. 7 on the basis of the pivot 60 when the movable member 21 moves on the base line L to the direction of arrow A illustrated in FIG. 7 to the fixing member 7.

In this embodiment of the present invention, although there are the engaging members, especially two engaging members, it may be used one of the engaging members. Moreover, the engaging member 31 (32) is attached to the fixing member 7, on the other hand, the engaged parts 27, capable of detaching the engaging member 31 one by one, is formed continuously to the movable member 21, however, a person who skilled prior art may change the design as below.

Accordingly, the attachment base plate 9 of the mounting member 7 has the engaged plate parts 27 provided continuously on the base line L, in the same direction as the circumferential direction of the rotary reel, and the movable member 21 overlapped the attachment base plate 9 is provided at least one engaging member 31 (32), the engaging member 31 may detach to the engaged plate parts 27 gradually when the position of the photo sensor 40 is re-positioned by controlling the movable member 21. Therefore, such embodiment is also equivalent.

Moreover, it is not necessary to coincide the angle which corrects the position of a sensor with the number of steps. For example, it can also set up and use for arbitrary angles including 0.5-degree, 1-degree and 1.5-degree etc. In addition, although the slot machine is explained in this embodiment, it may be used also to the reel unit as a variable display of a pachinko machine or other game machines.

As set forth above, the advantages of the invention are as follows:

(1) The position of a sensor is easily correctable even if the person is not an expert.

(2) The position of a sensor is gradually correctable.

Figure 11:
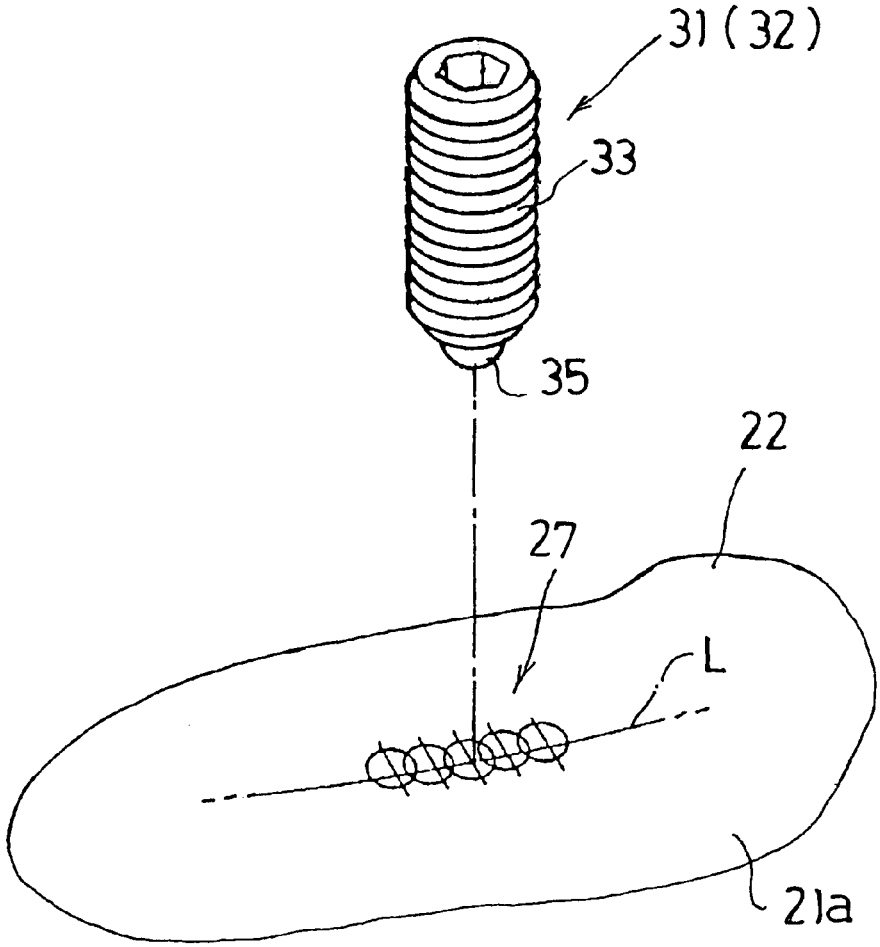
FIG. 11 illustrates an explanatory view for explaining the effect of one example of this invention.

(3) Also concerning a game machine equipped with rotary reels including a slot machine with a comparatively short radius, the narrow radius space of the rotary reel can be utilized effectively, and the object of the above-mentioned (2) can be attained. FIG. 11 illustrates that the engaging holes as an example of the engaged part overlap when a fine angle (gradual step-adjustment) is required to the rotary reel with the short radius on the assumption that one of the engaging member 31 (or 32) is used. Therefore, the invention described in claims 2 and 3 can fully acquire the effect of the mentioned in (3).

(4) The number of parts to constitute can be lessened, and each part can be combined rationally.

What is claimed is:

1. A rotary reel unit for a game machine supported on a frame (1) and a support member (4) fixedly mounted in a vertical state in said frame, said rotary reel unit comprising:

a mounting member (7) fixed to said support member, and including an attachment base plate 9;

a movable member (21) provided on said attachment base plate (9) and having a photo sensor (40) for an index provided on a rotary reel (50);

said attachment base plate (9) including at least one engaging member (31, 32);

an engaged plate part (22) on said movable member (21) having a plurality of engaged detents (27) positioned in spaced relation along an accurate base line L extending in the same direction as a circumferential direction of said rotary reel; and said engaging member being adapted to engage said engaged detents (27) in serial order when the position of said photo sensor (40) is re-positioned by controlling said movable member (21).

2. A rotary reel unit for the game machine according to claim 1, wherein said engaged plate part (22) of said movable member (21) further includes at least one elongated adjustment slot (28) which extends in the direction of base line L, the unit further comprising means for adjusting the position of said movable member relative to said attachment base plate.

3. A rotary reel unit for the game machine according to claim 1, wherein said at least one engaging member (31, 32) comprises a plurality thereof, and one of said engaging members (31, 32) always engages with any one of said engaged parts (27).

4. A rotary reel unit for the game machine according to claim 1, wherein said mounting member (7) comprises a case (8) for a motor.

5. A rotary reel unit for the game machine according to claim 3, wherein said plurality of detents (27) further includes first engaged holes (a1, a2, and a3) with which one engaging member (31) detaches and second engaged holes (b1 and b2) with which another engaging members (32) detaches.

6. A rotary reel unit for the a game machine mounted to a frame (1) and a support member (4) fixedly mounted at a vertical state in said frame, said rotary reel unit comprising:

a mounting member (7) fixed to a sidewall of said support member, the mounting member having an attachment base plate (9);

a movable member (21) provided on said attachment base plate (9) and being operably connected to a photo sensor (40) for indexed movement relative to a rotary reel (50);

said attachment base plate (9) having a plurality of engaged plate parts (27) provided in spaced relation along a base line L extending in the same direction as a circumferential direction of said rotary reel; and said movable member (21) having at least one engaging member, said at least one engaging member positioned to engage said engaged plate parts (27) in serial order when the position of said photograph sensor (40) is re-positioned by movement of said movable member (21).

* * * * *

UNITED STATES PATENT AND TRADEMARK OFFICE

CERTIFICATE OF CORRECTION

PATENT NO. : 6,802,507 B2
DATED : October 12, 2004
INVENTOR(S) : Haruo Inoue

It is certified that error appears in the above-identified patent and that said Letters Patent is hereby corrected as shown below:

Title page,
Item [57], ABSTRACT, please correct to read as follows:
-- A rotary reel unit for a game machine mounted to a frame through a support member fixedly provided in a vertical state, the rotary reel unit including a fixing member fixed to one of sidewalls of the support member, having a attachment base plate; a movable member provided at the attachment base plate, having a photo sensor to an index provided to the rotary reel; the attachment base plate provided at least one engaging member; an engaged plate part of the movable member having a plurality of engaged plate parts provided continuously thereto on the base line L positioned at the same direction as a circumferential direction of the rotary reel; and the engaging member detached to thee engaged plate parts in serial when the position of the photo sensor is re-positioned by controlling the movable member so that the position of the sensor can be easily corrected by a person who is not an expert. --

Signed and Sealed this

Thirtieth Day of November, 2004

JON W. DUDAS
*Director of the United States Patent and Trademark Office*